US008468747B2

(12) United States Patent
Mingardi et al.

(10) Patent No.: US 8,468,747 B2
(45) Date of Patent: Jun. 25, 2013

(54) ELECTROMECHANICAL ACTUATOR FOR A CLOSURE AND AN ASSEMBLY INCLUDING THE ACTUATOR AND CLOSURE

(75) Inventors: Marco Mingardi, Calderino di Monte San Pietro (IT); Eric Lagarde, Sallanches (FR)

(73) Assignee: Somfy SAS, Cluses (FR)

( * ) Notice: Subject to any disclaimer, the term of this patent is extended or adjusted under 35 U.S.C. 154(b) by 392 days.

(21) Appl. No.: 12/312,871

(22) PCT Filed: Nov. 30, 2007

(86) PCT No.: PCT/FR2007/001968

§ 371 (c)(1),
(2), (4) Date: Feb. 4, 2010

(87) PCT Pub. No.: WO2008/071887

PCT Pub. Date: Jun. 19, 2008

(65) Prior Publication Data

US 2010/0139171 A1 Jun. 10, 2010

(30) Foreign Application Priority Data

Dec. 1, 2006 (FR) ..... 06 10524

(51) Int. Cl.
*E05F 11/00* (2006.01)

(52) U.S. Cl.
USPC ..... 49/325; 52/200

(58) Field of Classification Search
USPC ... 49/324, 325, 197, 199, 123; 52/200; 474/1, 474/2, 3, 100
See application file for complete search history.

(56) References Cited

U.S. PATENT DOCUMENTS

| | | | | |
|---|---|---|---|---|
| 4,014,136 | A * | 3/1977 | Hemens et al. | 49/325 |
| 5,271,182 | A * | 12/1993 | Greisner et al. | 49/325 |
| 5,659,160 | A * | 8/1997 | Tracey | 187/316 |
| 5,896,702 | A | 4/1999 | Waehrens et al. | |
| 6,021,605 | A * | 2/2000 | Laux et al. | 49/361 |
| 7,290,369 | B2 * | 11/2007 | Tarrega Lloret | 49/123 |
| 2007/0169414 | A1 * | 7/2007 | Soerensen | 49/325 |

FOREIGN PATENT DOCUMENTS

| | | |
|---|---|---|
| EP | 0 777 028 A1 | 6/1997 |
| EP | 1 353 031 A1 | 10/2003 |

* cited by examiner

*Primary Examiner* — Jerry Redman
(74) *Attorney, Agent, or Firm* — Dowell & Dowell, PC

(57) ABSTRACT

An actuator for opening and closing a closure including a motor, a sprocket rotated by the motor, and a chain driven by the sprocket and having a first end connected to the closure and a second end positioned within a casing. The actuator also includes a support mounted so as to reciprocally movable relative to the sprocket and having a guide through which a portion of the chain is movable so that the movement of the support is due to the chain being driven by the sprocket.

11 Claims, 8 Drawing Sheets

ELECTROMECHANICAL ACTUATOR FOR A CLOSURE AND AN ASSEMBLY INCLUDING THE ACTUATOR AND CLOSURE

BACKGROUND OF THE INVENTION

1. Field of the Invention

The invention falls into the field of actuators for automatically maneuvering opening leaves of a house or a building in general, of the door or window type. It also falls into the field of closing assemblies comprising, amongst other things, such actuators.

2. Brief Description of the Related Art

Some of these actuators comprise a geared electric motor assembly capable of transmitting a movement to an arm, which pushes or pulls on the opening leaf, depending on the direction in which the geared motor unit is rotating.

In such an actuator, the arm may consist of a chain driven by a sprocket, itself connected to the output shaft of the geared motor unit by means optionally of an angle transmission. This chain is made up of links which may nest inside one another in such a way as to stiffen the chain so that it can be bent in only one direction. Thus, the rigid chain is able to transfer a mechanical force in order to pull or to push the opening leaf. The chain is generally folded up in a casing, around a guiding support which is fixed in the casing. It slides with respect to this guide when set in motion.

To maneuver large or heavy opening leaves, DE U 91 05 454 discloses the use of a device combining two assemblies each comprising a drive member and a maneuvering chain. The two drive members are electronically coupled so that they operate precisely at the same time. The differences in chain lengths or lash in the driveline create difficulties in adjusting and installing such a device.

Another approach is to use a mechanical synchronizing mechanism as described in U.S. Pat. No. 1,333,595. This mechanism is intended for the control of several opening leaves simultaneously or of one opening leaf that is heavy or unusually large in size. A double mechanism involving chains and sprockets is then used, the chains being connected at one end to the opening leaf and at the other end to a common drive member which moves longitudinally with respect to the opening leaf. As the drive member moves in a first direction of opening, the chains are driven and folded along guiding supports, from the drive element toward the opening leaf, and push on the latter in order to open it. Conversely, when the drive member is moved in an opposite second direction of closing, the chains are driven and folded along the guiding supports toward the drive member and pull on the opening leaf in order to close it. The mechanical structure of the chains allows the chains to be folded along the guiding supports.

On the other hand, EP-A-0 777 028 describes a mechanism the structure of which improves compactness and esthetics. This mechanism is also suited to automatically actuating heavy opening leaves or to countering the effect of the wind on windows that exhibit extensive windage, and to actuating opening leaves positioned side by side. An electric drive device, chains, return sprockets and guides for the chains are contained in a substantially closed casing provided with openings in a common face through which the chains leave. The guides are formed of grooves cut into the mass of the casing and in which the chains slide over their entire length. This is expensive and causes a great deal of slack in the movement of the chains.

SUMMARY OF THE INVENTION

It is an object of the present invention to address the various problems mentioned hereinabove in a simple and economical way while at the same time offering a structure that is modular, practical, and provides a large flexibility for fitting and adapting to suit opening leaves of various sizes or weights.

To this end, the invention relates to an electromechanical actuator for maneuvering an opening leaf, this actuator comprising a motor, a sprocket driven by the motor and a chain driven by the sprocket and comprising a first end intended to be connected to the opening leaf that is to be actuated. This actuator is characterized in that it also comprises a support for a part of the chain, this support being mounted such that it is free in terms of translational movement along an axis perpendicular to the axis of rotation of the sprocket and equipped with means of interacting with the chain, such that the translational movement of the support along the abovementioned axis is the result of the chain being driven by the sprocket.

Thanks to the invention, the position of the support along the axis along which it slides is automatically adapted, such that the support is always optimally positioned for guiding that part of the chain that lies between its second end and the drive sprocket, the length of which part of the chain varies with the movements to open and to close the opening leaf.

According to advantageous but non-compulsory aspects of the invention, such an actuator may incorporate one or more of the following features:

- the means of interaction comprise a guide, in which the chain can slide, this guide comprising two guide elements to which the chain selectively applies a force when driven by the sprocket;
- the support is guided in a translational movement through cooperation of shapes with a casing of the actuator;
- the support is mounted such that it can slide along a rod the longitudinal axis of which is fixed with respect to the casing;
- the rod is kinematically linked to an output shaft of the motor so that rotation of this axle causes the rod to rotate, while the support is mounted such that it can slide freely along the rod;
- the rod causes a second sprocket to turn in a way that is synchronized with the first sprocket, and a second chain is driven by the second sprocket and supported by a second support also mounted on the rod;
- the second end of the chain is mounted fixed with respect to a casing of the actuator. As an alternative, the second end of the chain is free. In this case, the second end of the chain or the support advantageously comprise an immobilizing element allowing the chain to be retained relative to the support in a direction of movement of the chain that corresponds to the opening of the opening leaf.

The invention also relates to a closing assembly comprising an opening leaf able to move between an open position and a closed position, this assembly further comprising at least one actuator as mentioned hereinabove.

BRIEF DESCRIPTION OF THE DRAWINGS

The invention will be better understood and other advantages thereof will become more clearly evident in the light of the description which will follow of nine embodiments of an actuator in accordance with the principle thereof, which is given solely by way of example and with reference to the attached drawings in which.

DESCRIPTION OF THE PREFERRED EMBODIMENTS

Figure 1:
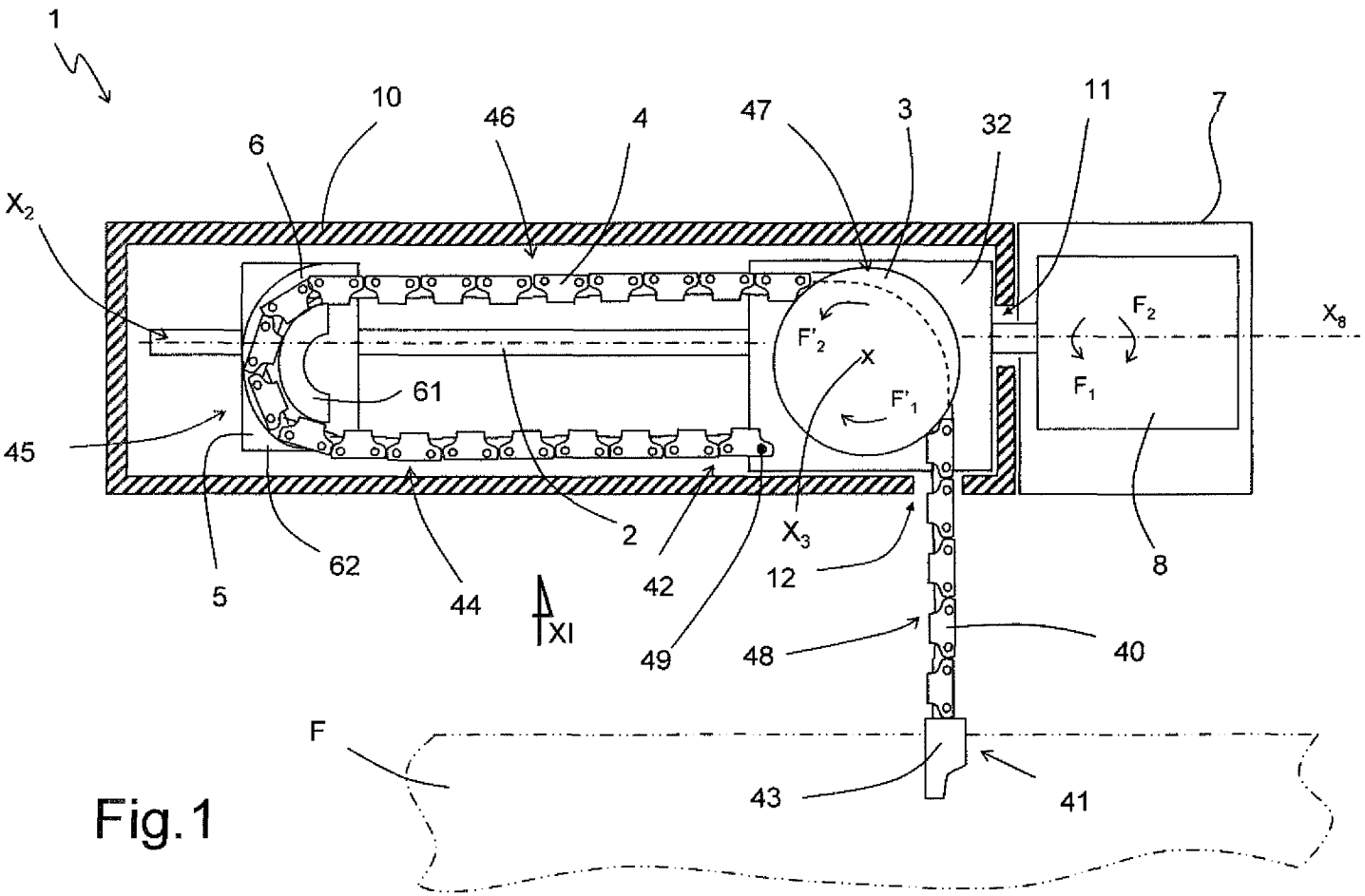
FIG. 1 is a diagrammatic longitudinal section of an actuator according to a first embodiment of the invention taken along line 1-1 of FIG. 11.

FIG. 1 schematically depicts, in section, an actuator 1 of the "single chain" type for the electromechanical maneuvering of an opening leaf such as a window or other closure F. A casing 10 is provided with a first opening 11 for the passage of an output shaft 81 of an electric motor 8 housed in a second casing 7 attached to the casing 10. The casing 10 is of elongate shape and its longitudinal axis is denoted $X_{10}$. The longitudinal axis of the shaft 81 about which this shaft rotates when the motor 8 operates is denoted $X_8$. The axes $X_8$ and $X_{10}$ are parallel.

The shaft 81 allows a sprocket 3 to be rotated about its axis $X_3$ perpendicular to the plane of the drawing and to the axes $X_8$ and $X_{10}$. Reduction gearing with an angle transmission, housed in a box 32, provides the kinematic link between the shaft 81 and the sprocket 3.

A rod 2 is connected to the box 32. It may be mounted such that it is fixed or able to rotate with respect to the box. The rod 2 has its longitudinal axis $X_2$ coinciding with the axis $X_8$. The axis $X_2$ may equally be laterally offset with respect to the axis $X_8$, while at the same time remaining parallel thereto.

The sprocket 3 has teeth, not depicted, that allow it to mesh with the links 40 of a drive chain 4. This chain 4 is arranged in the casing 1 and at least partially emerges from this casing 10 through a second opening 12 therein. The first end 41 of the chain, positioned on the outside of the casing 10, is fitted with an end-of-travel element 43 which, on the one hand, allows the chain to be secured to the window F and, on the other hand, prevents the chain 4 from being completely retracted into the casing 10, because the element 43 is unable to pass through the opening 12.

The second end of the chain is immobilized on the box 32 of the sprocket 3 by a peg 49, fixed to the box and over which the last link 40 of the chain 4 is engaged.

Provided in the actuator casing 10 is a support 5 comprising a guide 6 for the chain 4, and around which the chain is folded inside the casing. This construction makes it possible to increase the available chain length without increasing the size of the complete actuator because the chain can be folded up on itself. The support 5 is mounted so that it can slide on the rod 2. It therefore forms a slider free to effect a translational movement along the axis $X_2$, that is to say parallel to the axes $X_{10}$ and $X_{81}$, and is able to guide the chain at various levels along the casing 10. The support or slider 5 is constructed in such a way that it accompanies the movement of the chain in both directions of motion.

The support 5 comprises a guide 6 in the form of a central peg 61 and of a semi-circular guide 62 between which the chain 4 passes. The chain 4 is curved around the central peg 61, over approximately 180°, and this peg then forms a bearing about which the chain slides.

Figure 2:
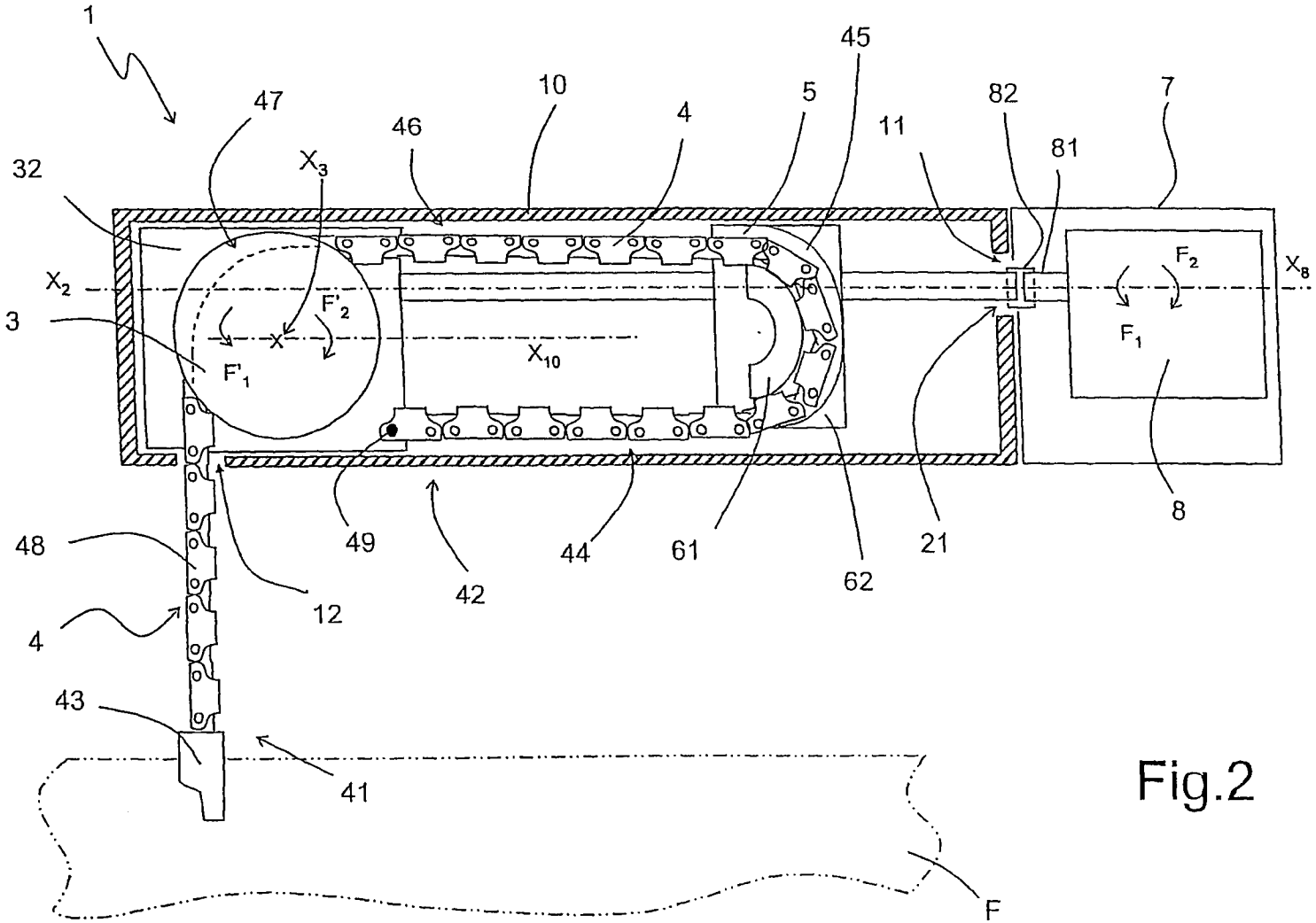
FIG. 2 is a view similar to FIG. 1 for an actuator according to a second embodiment of the invention.

In the second embodiment of the invention depicted in FIGS. 2 and 3, elements similar to those of the first embodiment bear the same references. In this embodiment, the rod 2 is mounted on the box 32 while being able to rotate about its longitudinal axis $X_2$ and being meshed with the gears positioned inside this box. It is thus possible for the electric motor 8 located inside the casing 7 to be connected to that end 21 of the rod 2 that is at the opposite end to the box 32, this being with a view to transmitting the rotational movement of the output shaft 81 of the motor 8 to the sprocket 3.

A sleeve 82 is positioned around the end 21 and around the adjacent end of the shaft 81 in order to secure this shaft to the rod 2 in terms of rotation.

As in the previous embodiment, a support 5 is mounted such that it can slide along the rod 2, that is to say parallel to the axis $X_2$, to the axis $X_8$ of rotation of the shaft 81, and to a longitudinal axis $X_{10}$ of the casing 10.

Figures 3A, 3B, 3C:
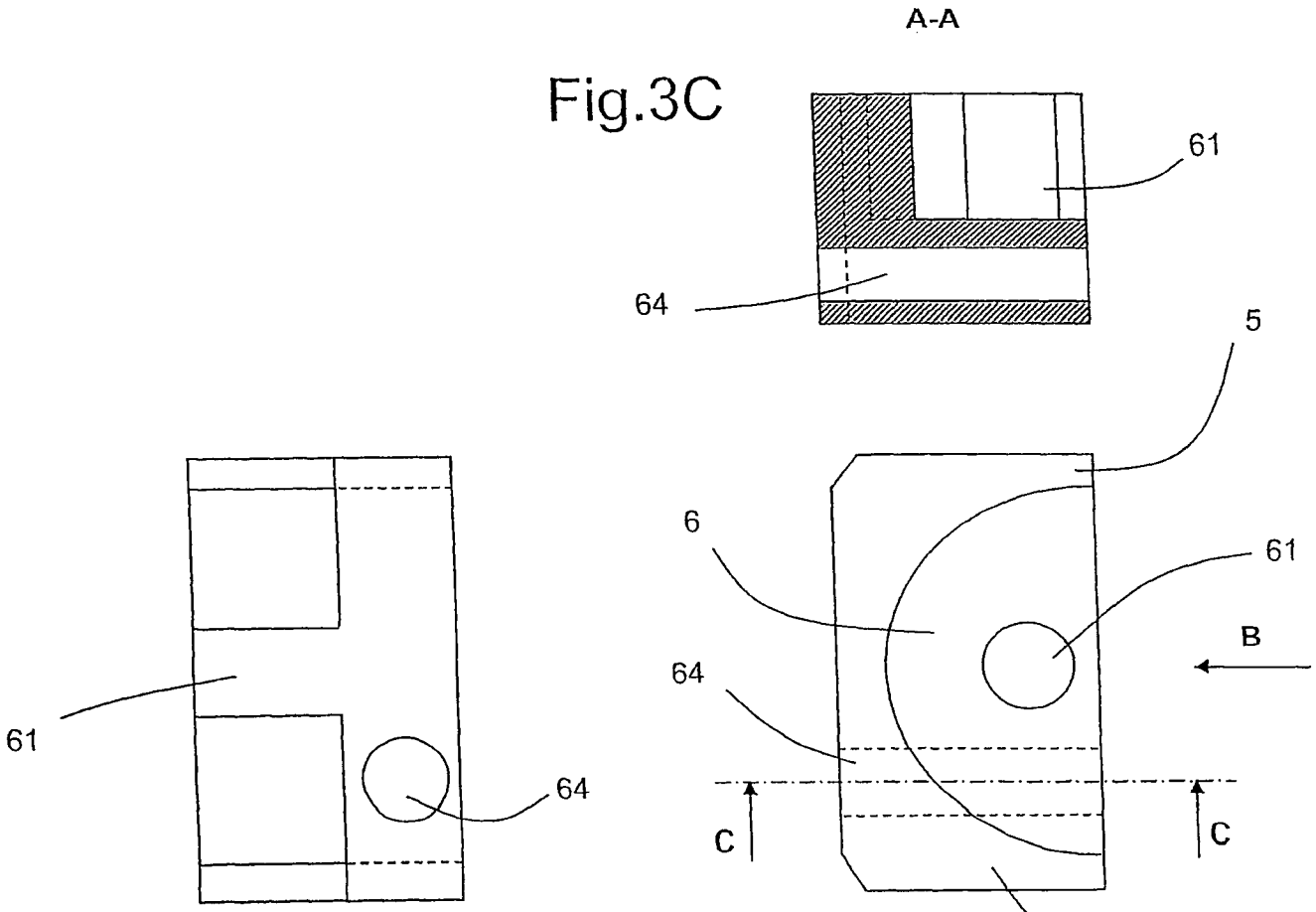
FIG. 3A is a front view of a support used in the actuator of FIG. 2.
FIG. 3B is a side view of the support in the direction of arrow B in FIG. 3A.
FIG. 3C is a section on C-C of FIG. 3A.

The support 5 is more specifically visible in FIGS. 3A to 3C. It is obtained by machining a block of plastic. In an upper part, it has two guide elements, namely a central peg 61 and a semicircular guide 62 which together form the guide 6. In a lower part, the support 5 is provided with a hole 64 allowing it to be mounted with the possibility of sliding freely on the rod 2 which, in this embodiment, is a drive rod that drives the sprocket 3. This hole 64 is not necessarily centered with respect to the support 5.

The support in the first embodiment has, on the whole, the same shape as that of the second embodiment, the hole 64 being arranged differently.

In the two embodiments depicted in FIGS. 1, 2 and 3A to 3C, the degree of freedom of the support 5 in translational movement along the axis $X_2$ allows the following effects:

When the motor 8 is started, the sprocket 3 turns and drives the chain 4. Because the support 5 is able to move parallel to the axis $X_{10}$ of the casing 10, it is driven by the chain and slides in the direction that allows the chain to move around the sprocket. The movement of the support 5 is therefore tied to that of the chain 4. The support is pulled or pushed along the casing by the chain itself when it is maneuvered.

Once in place in the actuator casing 10, the chain is then articulated in 5 parts, as depicted in FIGS. 1 and 2:

- a first part 44 situated between the second end 42 and the support 5;
- a second part 45, partially wound in the guide 6;
- a third part 46 situated between the support 5 and the driving sprocket 3 in one and the same plane;
- a fourth part 47 partially wrapped around the drive sprocket 3;
- a fifth part 48 between the sprocket 3 and the first end 43 of the chain, outside the casing.

The various parts of the chain 4 are arranged in one and the same plane parallel to that of FIGS. 1 and 2.

In its retracted position, the chain is, for the most part, arranged along an axis parallel to the axis $X_2$, the first 44 and third 46 parts being parallel. The chain is wrapped over a quarter of a turn around the sprocket 3, so that it reemerges from the casing at right angle to the axis $X_2$.

When the motor 8 rotates in a first direction depicted by the arrows $F_1$ in FIGS. 1 and 2 and aimed at causing the chain 4 to exit the casing 1, the sprocket 3 is itself rotationally driven in a first direction depicted by the arrows $F'_1$. The links of the chain mesh with the sprocket 3 and are moved out of the casing. Thus, the fifth part 48 of the chain lengthens, while the first and third parts 44 and 46 become shorter. This change in length of the chain between the end 42 and the sprocket 3 is possible thanks to the free translational movement of the support 5 parallel to the axis $X_{10}$ of the casing 10 and thanks to the sliding of the chain in the guide 6 around the peg 61.

When the motor rotates in a second direction $F_2$ aimed at retracting the chain 4 into the casing 1, the sprocket 3 is itself rotationally driven in a second direction $F'_2$. The links of the chain mesh with the sprocket 3 and are brought into the casing. Thus, the fifth part 48 of the chain shortens while the first and third parts 44 and 48 become longer. This change in length is once again possible by virtue of the free translational movement of the support 5 parallel to the axis $X_{10}$ of the casing 10 and thanks to the sliding of the chain in the guide 6 around the peg 61.

According to an undepicted alternative form of embodiment of the invention, the second end 42 of the chain 4 may itself be fixed to the support 5. In that case, the chain is articulated into just three parts similar to the parts 46, 47 and 48 mentioned hereinabove, and the change in length is obtained by the sliding of the support inside the casing 10 parallel to the axes $X_2$, $X_8$ and $X_{10}$.

The embodiments depicted in FIGS. 1 and 2 have the advantage of offering a longer length of chain for a total casing length equivalent to that of the undepicted alternative form of embodiment.

Figure 4:
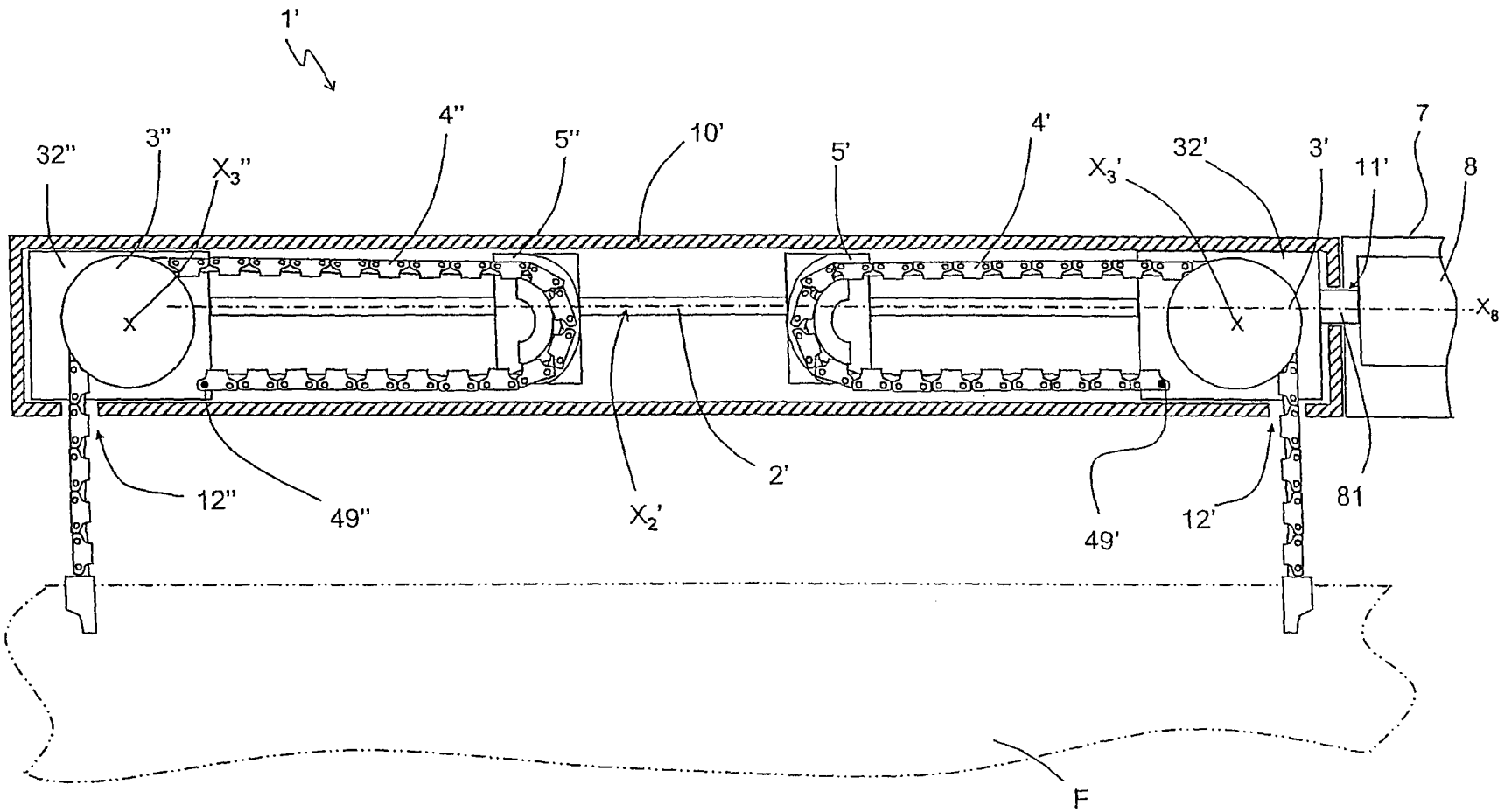
FIG. 4 is a section similar to FIG. 1, but on a smaller scale, of an actuator according to a third embodiment of the invention.

A "double-chain" actuator 1' is depicted in FIG. 4 and is made up of a casing 10' equivalent to the casing 10 but longer and equipped with a first opening 11' for the passage of the drive shaft 81. This drive shaft is kinematically linked, via appropriate gearing, firstly to a drive rod 2' and secondly to a sprocket 3' so that the rotation of the drive shaft about its axis $X_8$ causes the drive rod 2' to rotate about its longitudinal axis $X_2'$ and causes the sprocket 3' to rotate about its axis $X_3'$. The axis $X_3'$ of the sprocket is perpendicular to the axis $X_2'$ of the rod 2'. The sprocket 3' is mounted on a box 32' which is fixed with respect to the casing 1'. A gearset, not depicted, and housed in the box 32', is provided for the rotational drive of the sprocket 3' and of the rod 2'. In that respect, the actuator is similar to the actuator described in FIG. 1.

The drive rod 2' is, however, longer than for a single-chain actuator and its opposite end to the shaft 81 is kinematically linked, via appropriate gearing, to a second sprocket 3" mounted on a second box 32", this part being similar to the actuator described in relation to FIG. 2.

According to an alternative form of embodiment of the invention, the drive rod 2' may be rotationally driven via the sprocket 3'.

Because the second sprocket 3' is rotationally driven via the rod 2' it is possible, by choosing appropriate gearing, for its rotation to be synchronized with that of the first sprocket 3'. What is meant here by synchronized is that the speeds are synchronized, with a possible reversal in the direction of rotation of the sprockets. Because this synchronizing is mechanical, it does not introduce the disadvantages mentioned hereinabove in respect of electronic synchronization.

The casing 10' comprises two openings 12' and 12" through which two chains 4' and 4" respectively driven by the sprockets 3' and 3" exit. The sprockets 3' and 3" are arranged substantially at the ends of the casing 1'. Two supports 5' and 5" are mounted on the drive rod 2' and can slide parallel to its axis of rotation $X_2'$ accompanying the movement of the chains 4' and 4". The supports 5' and 5" are mounted between the sprockets 3' and 3" and are similar to those of the first two embodiments.

The supports 5' and 5" separate from one another when the chains 4' and 4" are driven towards the outside of the casing 10', which corresponds to the opening of an opening leaf in the form of a window F, and move closer toward one another when the chains are driven toward the inside of the casing 10', which corresponds to the closing of the opening leaf.

In another embodiment, which is not been shown, the supports 5' and 5" follow on from one another in a first direction, when the chains 4' and 4" are driven toward the outside of the casing 10', which corresponds to the opening of the opening leaf, and in the second direction when the chains are driven toward the inside of the casing 10', which corresponds to the closing of the opening leaf. In this embodiment, the box 32' supporting the first sprocket 3' is located at one end of the casing 10', while the second box 32" supporting the second sprocket 3" is situated in a central part of the casing 10'.

In the various scenarios, the chains are positioned in relation to the sprockets and to the supports as was described hereinabove in conjunction with the single-chain actuators depicted in FIG. 1 or 2.

According to some non-represented alternative forms of the invention, the actuator may comprise more than two sprockets, thus making it possible to operate three or more chains. In that case, the rod 2' is extended beyond the gap between the sprockets 3' and 3" in FIG. 4. As an alternative, a different rod may be used to transmit motion from the sprocket 3".

Various constructions of the various elements of the actuator are possible, advantageously looking to rationalize the number of different components.

Figure 5:
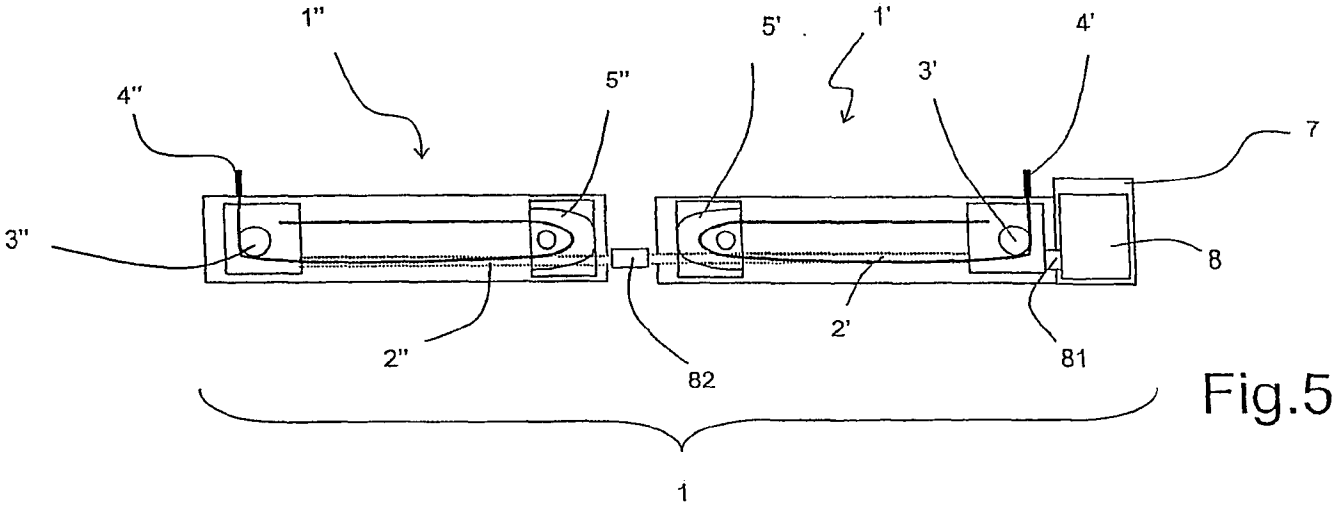
FIG. 5 is a schematic diagrammatic depiction of an actuator according to a fourth embodiment of the invention.
Figure 6:
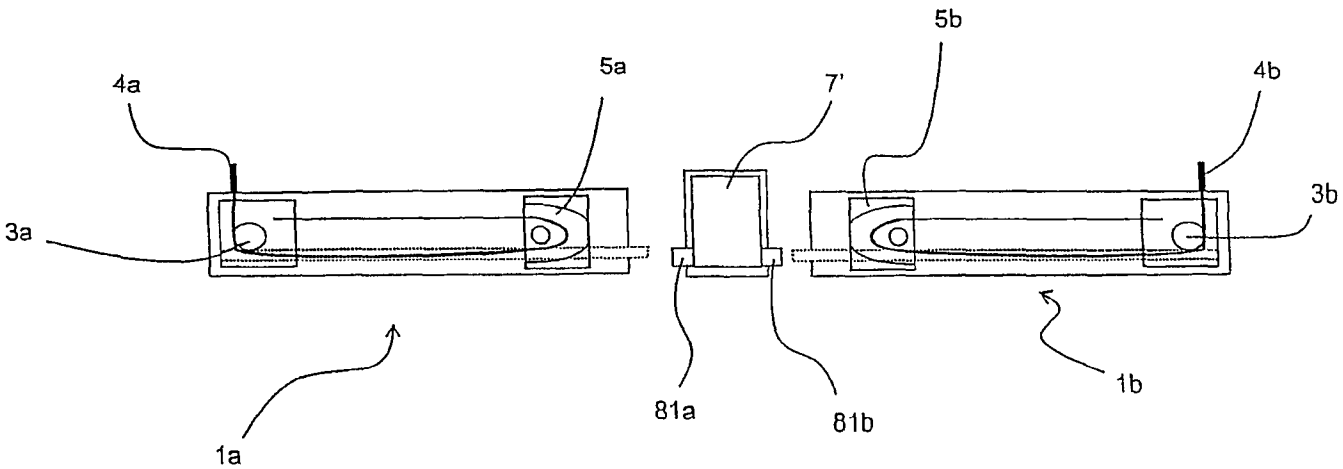
FIG. 6 is a schematic diagrammatic depiction of an actuator according to a fifth embodiment of the invention.
Figure 7:
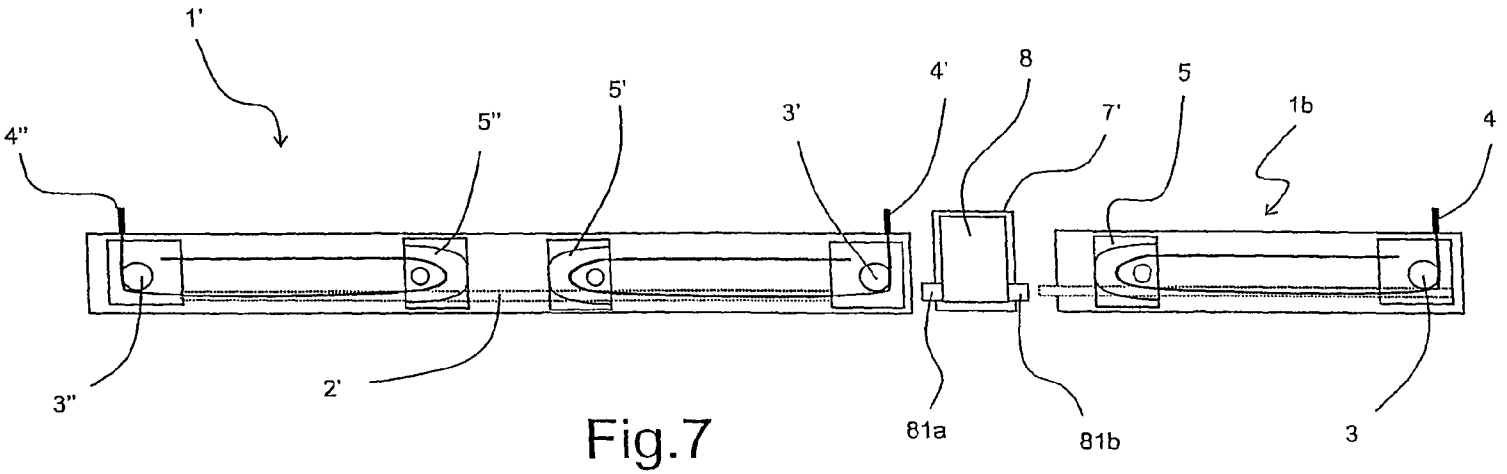
FIG. 7 is a schematic diagrammatic depiction of an actuator according to a sixth embodiment of the invention.

FIGS. 5 to 7 embody various uses of the single-chain or double-chain actuators described hereinabove.

Another type of double-chain actuator can be constructed from two single-chain actuators 1' and 1" one of which has no motor and the rods 2' and 2" of which are connected by a mechanical coupling element such as a sleeve 82. Such an actuator 1 is schematically depicted in FIG. 5. Each actuator 1' or 1" comprises a sprocket 3' or 3" able to control the movements of a chain 4' or 4" which is engaged in a support 5' or 5" able to move along the rod 2' or 2" of the relevant actuator. The structure obtained is similar to that of FIG. 4, the main difference being that there is no need to provide a double-length casing, like the one 10' in the third embodiment.

Moreover, as depicted in FIG. 6, a motor casing 7' may be developed in such a way that it has two outputs with inverted axes 81*a* and 81*b* on either side of the casing. Thus, two single-chain actuators 1*a* and 1*b* can be coupled, one on each side of this motor casing, to the two outputs 81*a* and 81*b*, to form a double-chain motorized actuator.

Finally, other combinations are possible, so as to create three-chain or four-chain motorized actuators. Thus, a single-chain actuator 1*b* and a double-chain actuator 1' may be coupled one on each side of a motor casing 7' with two outputs 81*a* and 81*b*, to form a triple-chain motorized actuator as illustrated in FIG. 7.

The various motor casings depicted in FIGS. 5 to 7 show axles merging from one or both sides of the casing. As an alternative, a motor casing with no protrusions may be provided. There are then two possible scenarios. In a first scenario, the casing 10 or 10' containing the chains 4, 4', 4" has a protruding axle, which can be coupled at the motor casing, as depicted in FIG. 1. In a second scenario, use is made of a mechanical sleeve to transmit motion between the motor and the drive rod or sprockets, as depicted in FIG. 2.

Figure 8:
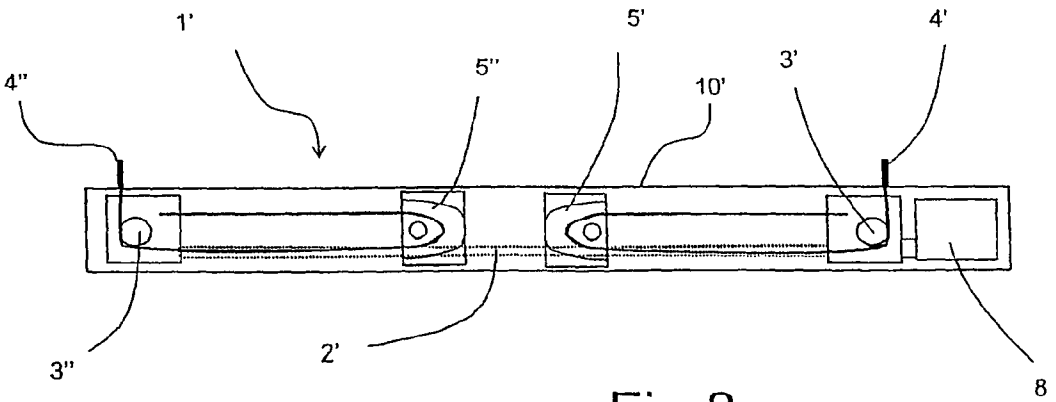
FIG. 8 is a schematic diagrammatic depiction of an actuator according to a seventh embodiment of the invention.

Another embodiment is depicted in FIG. 8. The motorized actuator 1' is then produced in just one casing 10', the motor 8 being incorporated into this casing that also contains the chains 4' and 4", the sprockets 3' and 3", the supports 5 and 5' and the rod 2'.

In the above embodiments, the second end 42 of the chains 4, 4,' or 4" is designed to be fixed with respect to the casing 10 and equivalent or to the box 32 and equivalent or connected directly to the support 5. However, this end 42 may be designed to be free in relation to the casing and to the support. The support 5 does, however, still guide the chain over part of its path.

Figure 9:
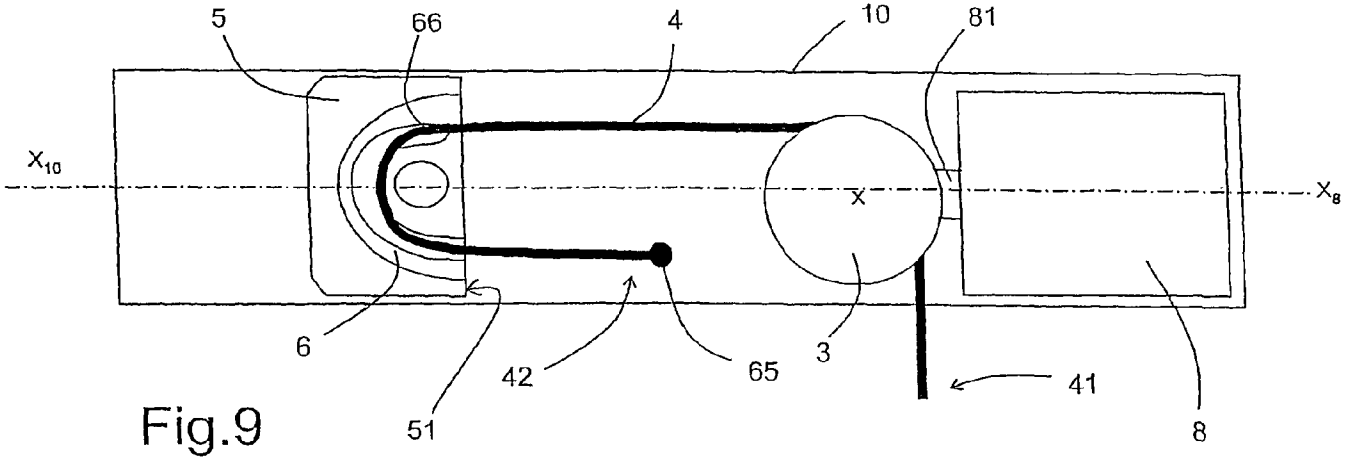
FIG. 9 is a schematic diagrammatic depiction of an actuator according to an eighth embodiment of the invention.

In this case, as depicted in FIG. 9, it is advantageous to provide on the chain 4 or on the support 5, an immobilizing element 65 which immobilizes the passage of the second end 42 of the chain 4 in the guide 6. Thus, if the chain is maneuvered in such a way as to leave the casing, for example if the support 5 is restrained by friction, the chain can slide in the guide 6 until the immobilizing element 65 restrains the chain 4 in relation to the support 5 by coming up against a face 51 of the support that faces toward the sprocket 3. Then, if the driving of the chain 4 continues, the chain causes a translational movement of the support. When the chain enters the actuator casing, and if, conversely, it is restrained in the support 5 by friction, the latter can slide to the end of its travel and the chain can slide in the guide 6 thereafter. These movements of the chain and of the support may equally occur simultaneously.

Figure 10:
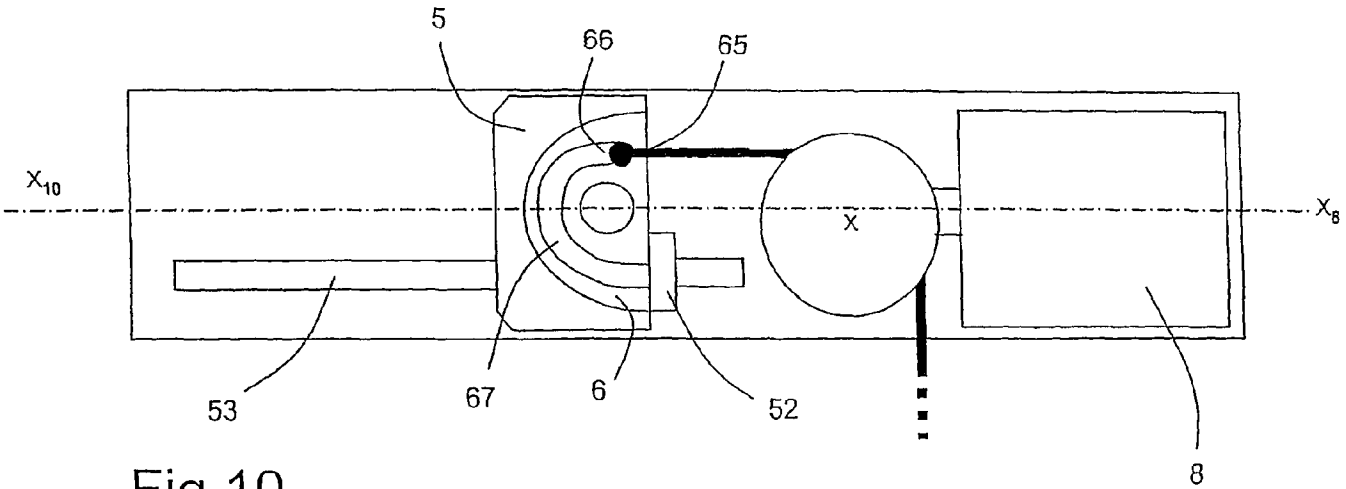
FIG. 10 is a view similar to FIG. 9 for an actuator according to a ninth embodiment of the invention.
Figure 11:
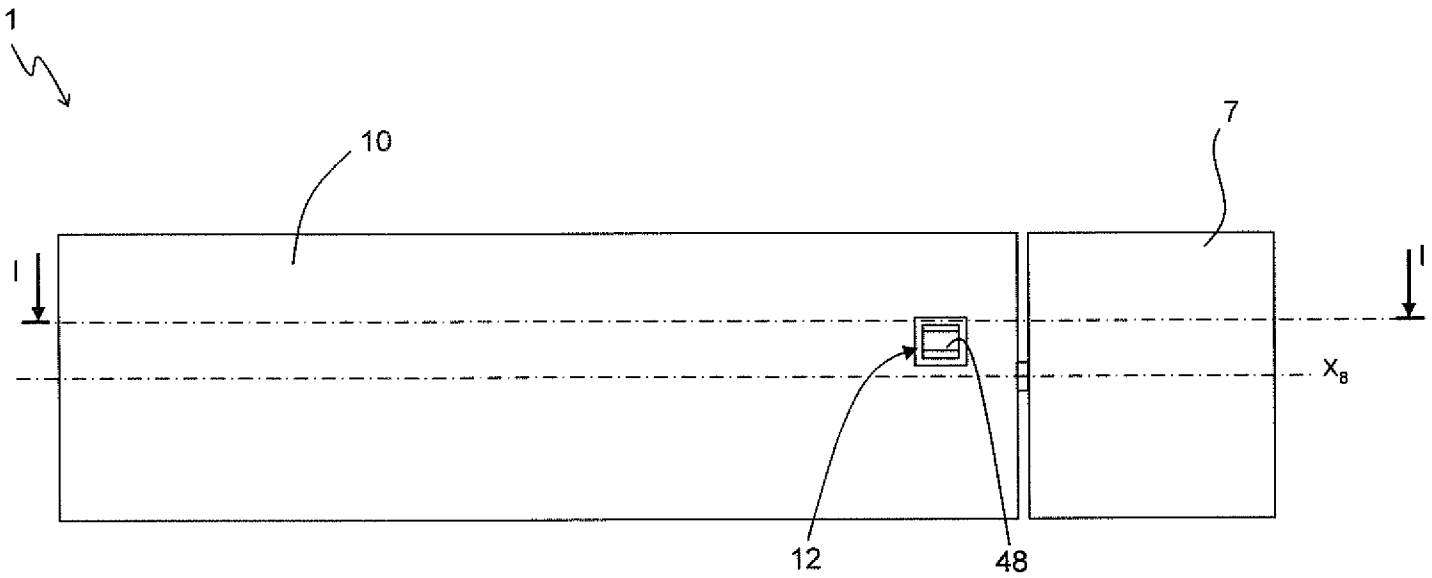
FIG. 11 is a bottom plan view of the actuator of FIG. 1 taken along the direction of the arrow X1 in FIG. 1.

In order to gain still further on available chain length and as depicted in FIG. 10, the second end 42 of the chain may also slide in the support 5 as far as an end stop 66 provided in this support 5 at the exit from the guide 6. An immobilizing element 65 then restrains the end 42 of the chain 4 in the support 5 at this end stop 66 when the chain is maneuvered in such a way as to leave the casing. The immobilizing element 65 is, for example, in the form of a peg able to slide in a groove 67 made in the support 5, this groove being closed at its end in order to form the end stop 66. Other embodiments of the immobilizing element 65, of the support 5 and/or the end stop 66 are of course conceivable.

In this embodiment, no guide rod is provided and the support 5 is guided in translational movement by cooperation of shapes with the internal faces of the casing 10.

In all the embodiments discussed, the travel of the support in a maneuver may be representative of a deployed length of chain. It is therefore advantageous to provide an adjustable end stop 52 which limits the travel of the support 5 in the direction of deployment of the chain. As depicted in FIG. 10 only, this adjustable end stop may be positioned along an adjusting strip 53 on an inner side of the casing 10 of the actuator and block the progress of the support at a given point. When the second end 42 of the chain 4 is free in relation to the support and to the casing, it is possible for the chain to continue to slide in the support 5 once the support is immobilized by the adjustable stop 52. When the end 42 of the chain 4 itself becomes immobilized in relation to the support 5, the deployed length of chain is at its maximum. Thus, the degree of opening of the opening leaf is dependent on the position of the adjustable stop 52. In this case, the stopping of the motor is determined, for example, by monitoring torque or variations in torque.

Various other combinations are of course conceivable, it being possible for the motorized actuator thus produced to meet the various size and weight requirements of the opening leaves that have to be maneuvered.

Several sizes of motor may also be provided in order to supply the necessary power.

In all the embodiments that involve more than one chain, the directions of rotation of the sprockets are chosen appropriately so that the chains are set in motion simultaneously and in the same direction of maneuvering of the opening leaf.

The technical features of the embodiments envisioned hereinabove may be combined with one another. In particular, the supports 5 and equivalent of the embodiments of FIGS. 1 to 8 may be guided in the casings 10 and equivalent through cooperation of shapes, as depicted in FIGS. 9 and 10. In such a case, the rods 2 and equivalent may be omitted except when they have a driving function, in which case the clearance between the support and the rod can be increased.

The invention claimed is:

1. An electromechanical actuator for opening and closing a closure, comprising a motor, a sprocket driven by the motor, a chain driven by the sprocket and including a first end extending outwardly of the sprocket and adapted to be connected to the closure and a second remote from the first end, the actuator also includes a support for a portion of the chain, the support being mounted so as to be reciprocally movable relative to the sprocket, and the support including semi-circular guides between which the chain is slidably movable and which semi-circular guides are engaged by the chain as the chain moves relative to the support such that the reciprocal movement of the support relative to the sprocket is a result of the chain engaging the semi-circular guides as the chain is being driven by the sprocket.

2. The actuator as claimed in claim 1, wherein the semi-circular guides define a guide channel there between in which the chain slides, the chain applying a force to one of the semi-circular guides when driven by the sprocket in a first direction and applying a force to the other semi-circular guide when driven the sprocket in a second direction opposite the first direction.

3. The actuator as claimed in claim 1, wherein the actuator includes a casing in which the support is cooperatively guided in reciprocal movement, and the first end of the chain extending outside of the casing.

4. The actuator as claimed in claim 3, wherein the support slides along a rod and a longitudinal axis of the rod is fixed with respect to the casing.

5. The actuator as claimed in claim 4, wherein the rod is kinematically linked to an output shaft of the motor so that rotation of the output shaft causes the rod to rotate, and the support is mounted to slide freely along the rod.

6. The actuator as claimed in claim 5, wherein the rod causes a second sprocket to rotate in a way that is synchronized with the first sprocket, and a second chain being driven by the second sprocket and supported by a second support also mounted on the rod.

7. The actuator as claimed in claim 1, wherein a second end of the chain is mounted fixed with respect to a casing of the actuator in which the support is housed.

8. The actuator of claim 1,wherein second end of the chain is a free end which is movable relative to the actuator and the support.

9. The actuator of claim 8, wherein the second end of the chain includes an immobilizing element allowing the chain to be retained relative to the support in a direction of movement of the chain that corresponds to an opening of a closure.

10. The actuator as claimed in claim 8, wherein the support includes an immobilizing element allowing the chain to be retained relative to the support in a direction of movement of the chain that corresponds to an open position of the closure.

11. A closing assembly in combination with at least one actuator as claimed in claim 1, wherein the closure is movable between an open and closed position.

* * * * *